US007812232B2

(12) United States Patent
Dennis

(10) Patent No.: US 7,812,232 B2
(45) Date of Patent: Oct. 12, 2010

(54) MUSICAL INSTRUMENT VIBRATO MOUNTING ADAPTER PLATE

(75) Inventor: Terrance Dennis, Ringoes, NJ (US)

(73) Assignee: U.E. Corp., Ringoes, NJ (US)

( * ) Notice: Subject to any disclaimer, the term of this patent is extended or adjusted under 35 U.S.C. 154(b) by 0 days.

(21) Appl. No.: 12/500,708

(22) Filed: Jul. 10, 2009

(65) Prior Publication Data

US 2010/0011936 A1 Jan. 21, 2010

Related U.S. Application Data

(60) Provisional application No. 61/134,961, filed on Jul. 15, 2008.

(51) Int. Cl.
*G10D 3/00* (2006.01)

(52) U.S. Cl. ..... 84/299; 84/267

(58) Field of Classification Search ..... 84/300–302, 84/313, 267, 298, 299
See application file for complete search history.

(56) References Cited

U.S. PATENT DOCUMENTS

| | | | | |
|---|---|---|---|---|
| 3,411,394 | A | 11/1968 | Jones | |
| D269,440 | S | 6/1983 | Fender | |
| 4,796,505 | A | 1/1989 | Takeuchi | |
| 4,852,448 | A | 8/1989 | Hennessey | |
| D356,328 | S | 3/1995 | Pozzobon | |
| D392,993 | S | 3/1998 | Oaks | |
| D412,012 | S | 7/1999 | Park | |
| 7,521,616 | B2 | 4/2009 | Kahler | |
| 7,709,713 | B1 | 5/2010 | Pearce et al. | |
| 2002/0104424 | A1 * | 8/2002 | Spalt | 84/291 |
| 2004/0163529 | A1 * | 8/2004 | Hyakutake et al. | 84/737 |
| 2008/0141843 | A1 | 6/2008 | Thompson | |

* cited by examiner

*Primary Examiner*—Kimberly R Lockett
(74) *Attorney, Agent, or Firm*—Lawrence E. Lambelet, Jr.

(57) ABSTRACT

An adapter for mounting a vibrato device, such as a Bigsby Vibrato, to an electric guitar without making changes to the guitar body is provided herein. The vibrato device replaces the stop tailpiece leaving available mounting holes for the adapter. The vibrato device is then mounted to the adapter without the need to alter the guitar by drilling holes. The adapter locates the vibrato device on the guitar in a manner to maintain the critical bend angle of the guitar strings over the bridge. The adapter, with a minimalist profile, is barely visible when mounted. Alternative embodiments provide an adapter kit and a method for mounting the adapter.

8 Claims, 4 Drawing Sheets

MUSICAL INSTRUMENT VIBRATO MOUNTING ADAPTER PLATE

CROSS-REFERENCE TO RELATED APPLICATIONS

This application claims priority to U.S. Provisional Application No. 61/134,961, filed Jul. 15, 2008.

FIELD OF THE INVENTION

The present invention deals generally with the field of musical instruments and more specifically with guitars and further specifically with electric guitars.

BACKGROUND OF THE INVENTION

Many electric guitars include a guitar stop tailpiece to which the guitar strings are attached near the lowermost end of the guitar. It is common practice to remove a guitar stop tailpiece and replace it with a vibrato or tremolo, also commonly called a whammy bar, for the purpose of providing unique sounds while playing the guitar.

Vibrato mechanisms provide a means for changing the tension on all the strings of a guitar simultaneously. Changing the tension creates a pitch change in each vibrating string. This is accomplished by a moving tailpiece which pivots about an axis substantially perpendicular to the strings. A handle is provided to facilitate a pulse-like pivoting of the tailpiece while simultaneously playing the instrument.

Most vibrato mechanisms are retrofitted to guitars. This involves either routing out an internal space for part of the mechanism, such as balancing springs, or otherwise drilling mounting holes to secure the mechanism to the guitar body. In both cases, the guitar is permanently defaced and its resale value compromised. Furthermore, changing vibrato mechanisms, or removing the mechanism, leaves unsightly vestiges of the former mounting. It is no wonder that many guitar owners are hesitant to mount such devices.

There are numerous examples of vibrato mechanisms in the prior art. Two of these, which characterize the genre, are U.S. Pat. No. 4,497,236 to Rose and U.S. Pat. No. 4,632,005 to Steinberger.

The Bigsby® Vibrato is the ubiquitous after-market device. To mount it, the procedure involves removing the stop tailpiece, typically found on guitars with a Tune-o-matic style bridge, and mounting it to the guitar body with four screws. The mounting requires new holes in the guitar for the particular fastener layout. It would be desirable to accomplish the mounting without drilling new holes. What is needed and missing in the prior art is a mounting adapter for a vibrato device, and specifically a Bigsby Vibrato device, which utilizes the screw holes vacated by the removal of the stop tailpiece.

Furthermore, it would be desirable, when mounting the vibrato device, to effectively replace the stop tailpiece without changing the angle of the bend of the strings over the bridge. This bend effectively holds the location of an individual string in its saddle on the bridge, and the angle determines the sufficient amount of downward force required to stabilize the configuration. If the angle is too shallow, the string may drift from its saddle location and cause it to go out of tune. The angle could become too shallow if the vibrato device is located too far rearward of the bridge.

Additionally, if the device, mounted on an adapter as suggested above, is located too far rearward, the string tension creates a torque which stresses the mounting in a way not comprehended in the original design for the stop tailpiece mounting. The best location for the device reduces the moment arm to zero and places that component of the vibrato device holding the strings down squarely at the stop tailpiece location. Serendipitously, this is also the location for the optimal angle of bend. A mounting adapter plate of preferred design, thusly, would properly locate the vibrato mechanism with respect to the bridge and the stop tailpiece mounting holes.

The present invention provides an adapter plate with a two-point mounting system utilizing the holes already provided for mounting the stop tailpiece and without requiring any additional points of attachment to the guitar body. Because the fasteners are countersunk within, and flush with, the adapter plate, the vibrato device can be mounted over the adapter mounting to find its optimal positioning on the guitar body. The adapter plate contacts the guitar body at points buffered by a plurality of bumpers or footpads, preferably of felt or other similar material, mounted upon the bottom surface of a U-shaped adapter plate.

The U-shape, as opposed to a rectangular or block shape, becomes essentially concealed beneath the similar outline of the Bigsby device, rendering the adapter plate almost unnoticeable. The U-shape also allows for efficient fabrication of the part. The "U's" can be alternately inverted to nest together in a cutting layout, thus minimizing material use and waste. Furthermore, the U-shape, with essentially independent tines, can resonate with the strings to sustain tone through the guitar body.

SUMMARY OF THE INVENTION

A first object of the present invention is to provide a simple and effective means for securing a vibrato device from one of many different manufacturers to a musical instrument such as a guitar.

A second object of the present invention is to provide a means for mounting a vibrato device to a guitar body by utilizing existing mounting holes provided therein.

A third object of the present invention is to provide a means for mounting the vibrato device without requiring additional drilling or any permanent change to the configuration of either the musical instrument or the vibrato device.

A fourth object of the present invention is to provide an adapter that is concealed from view and notice when mounted beneath the vibrato device.

A fifth object of the present invention is to provide an adapter plate which is of minimal cost and avoids moving parts.

A sixth object of the present invention is to provide an adapter plate which is easy to manufacture, efficient of material use and simple to install.

A seventh object of the present invention is to provide an adapter plate including countersunk mounting holes to facilitate flush mounting of a vibrato device thereto.

An eighth object of the present invention is to provide a means for mounting which includes only two secure mounting points which map to pre-existing mounting holes in a preferred guitar.

A ninth object of the present invention is to provide a mechanism that precludes any permanent modification of the host musical instrument.

A tenth object of the present invention is to provide a means for minimizing any torque leverage on the attachment points of a mounted vibrato device.

An eleventh object of the present invention is to provide a means for optimizing the angle of bend of the strings over the bridge.

These and other objects of the invention to become apparent hereinafter in accordance with the invention are realized in a vibrato adapter for a guitar, having mounting holes for a tailpiece, comprising an adapter plate having a first plurality of pre-drilled holes matching the mounting holes of a vibrato device having mounting holes and a string hold-down bar. The first plurality of pre-drilled holes is located on the adapter plate so as to position the string hold-down bar at the tailpiece location on the guitar. The adapter plate further provides a means for concealment and a means for mounting-without-drilling-holes. The vibrato device can be mounted to the guitar by fastening it to the first plurality of pre-drilled holes In a preferred embodiment, the means for mounting-without-drilling-holes comprises a second plurality of pre-drilled holes matching the mounting holes for the tailpiece. In another aspect of the preferred embodiment, the means for concealment comprises substantially matching the peripheral outline of the adapter plate to the shoe-print of the vibrato device. In still another aspect of the preferred embodiment, the adapter plate takes the shape of a "U".

In an alternate embodiment, an adapter kit for a guitar having mounting holes for a tailpiece comprises a set of mounting screws for a vibrato device, an adapter plate, a set of mounting screws for the adapter plate compatible with the tailpiece mounting holes, and installation and product care instructions.

In another alternate embodiment, a method for installing a vibrato adapter on a guitar having strings and mounting holes for a tailpiece comprises the steps of removing the tailpiece, removing the guitar strings from the tailpiece, mounting an adapter plate to the tailpiece mounting holes with mounting screws, mounting a vibrato device to the adapter plate with other mounting screws, and re-stringing the strings onto the vibrato device.

As this is not intended to be an exhaustive recitation, other embodiments may be learned from practicing the invention or may otherwise become apparent to those skilled in the art.

DESCRIPTION OF THE DRAWINGS

While the invention is particularly pointed out and distinctly described herein, a preferred embodiment is set forth in the following detailed description which may be best understood when read in connection with the accompanying drawings, and in which.

DETAILED DESCRIPTION OF THE PREFERRED EMBODIMENT

Figure 1:
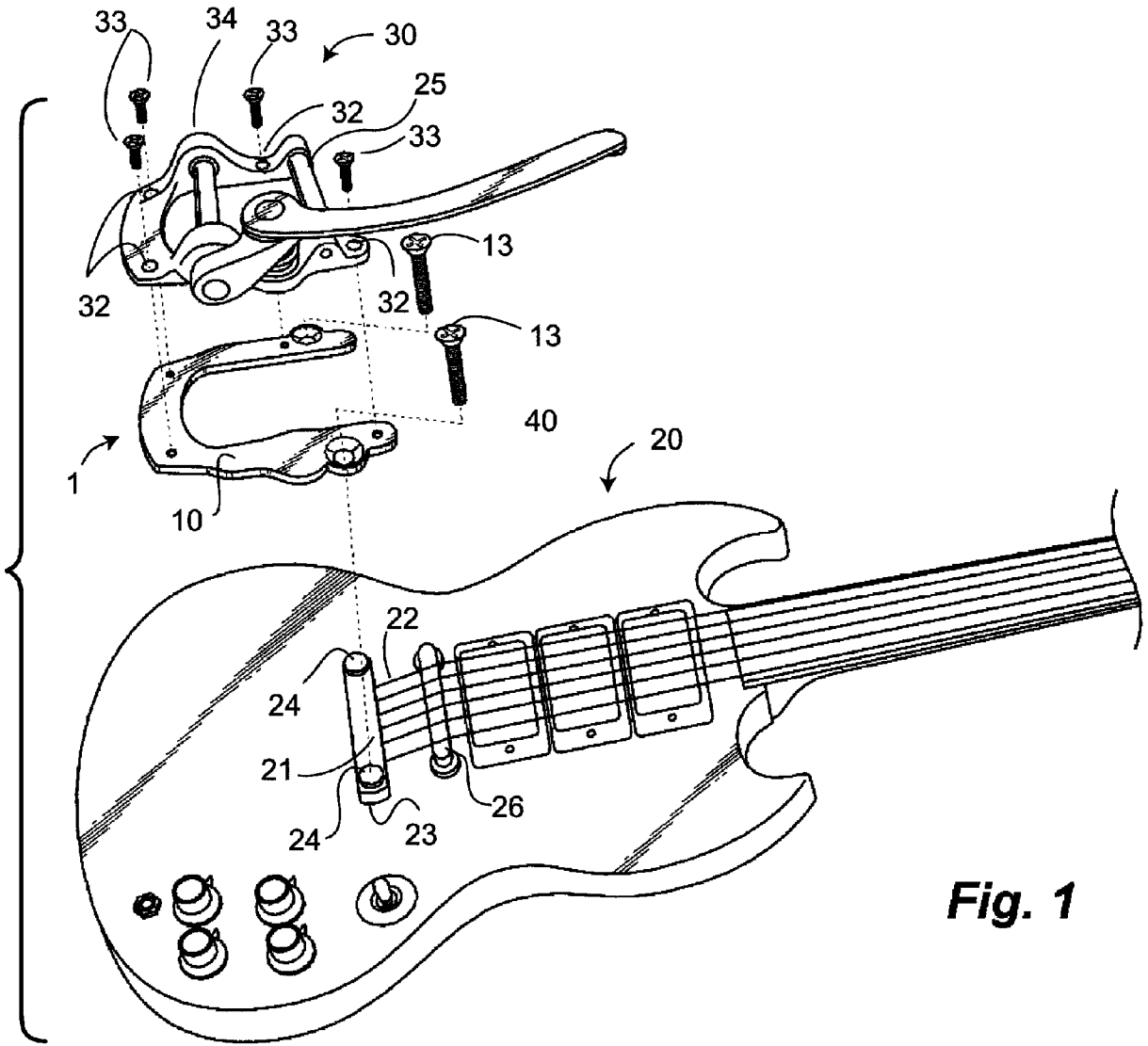
FIG. 1 is an exploded perspective view of the vibrato adapter of the present invention illustrating the relative positioning of system components.

As shown in FIG. 1, the present invention provides a vibrato adapter 1 designed to be secured to a guitar 20 to facilitate mounting of a vibrato device 30 with respect thereto. In the preferred embodiment, the vibrato device 30 is a Bigsby Vibrato 34.

Normally, a guitar body 20 includes a tailpiece 21 to which the guitar strings 22 are attached. The tailpiece 21 is attached to the guitar 20 through a plurality of tailpiece mounting holes 23 (suggested in the drawing). The tailpiece mounting holes 23 extend into the guitar 20 and are adapted to receive tailpiece mounting screws 24 to facilitate firm and secure mounting of the tailpiece 21 to the guitar 20. With the use of the vibrato device 30, the tailpiece 21 is no longer needed and for this reason the tailpiece mounting holes 23 can be utilized to facilitate mounting of the vibrato device 30 with respect to the guitar 20 without requiring any additional holes to be drilled in the guitar itself.

Figure 2:
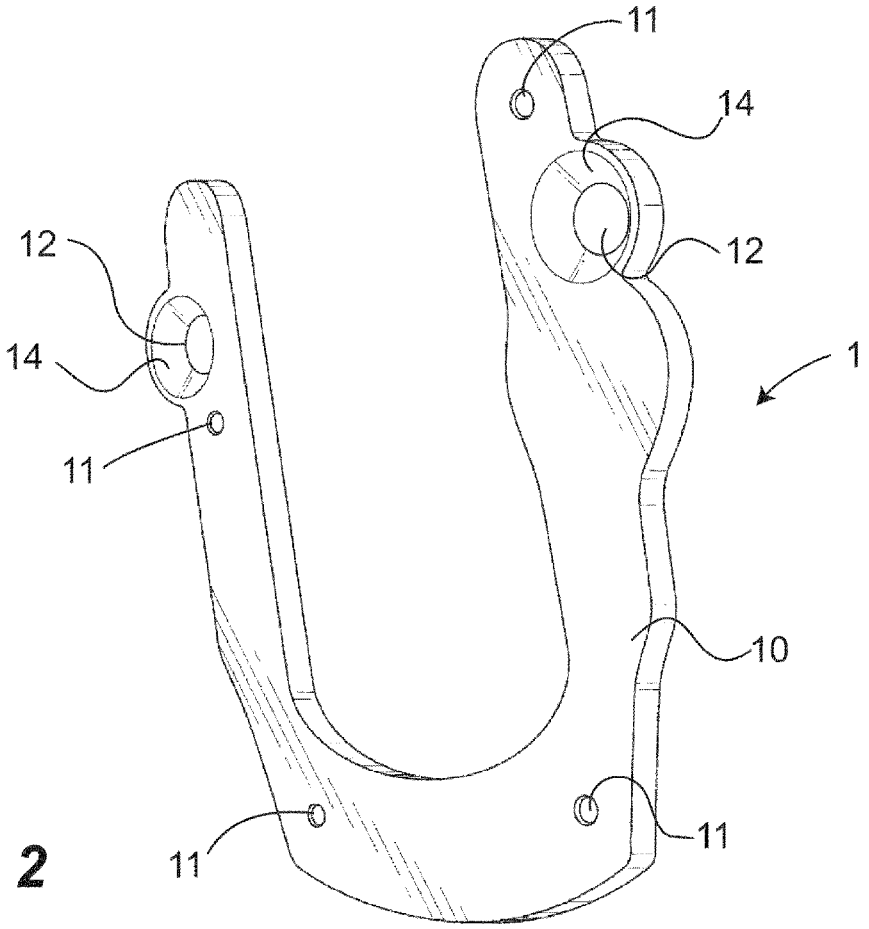
FIG. 2 is a perspective view of the adapter plate of the present invention.
Figure 4:
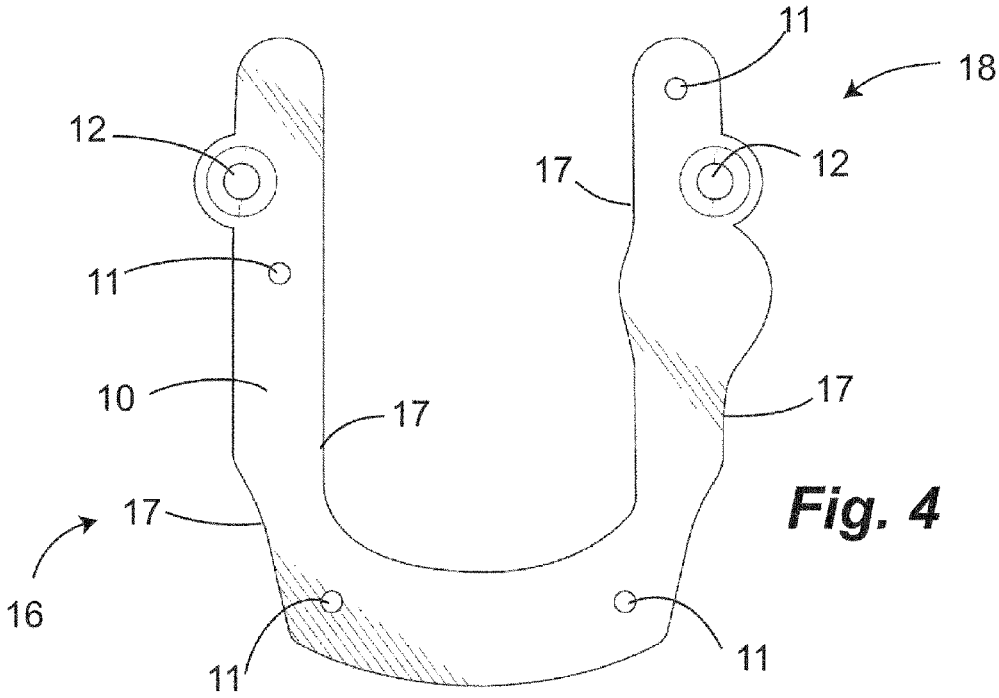
FIG. 4 is a top plan view of the adapter plate of the present invention.

Referring to FIGS. 1, 2 and 4, the vibrato adapter 1 is comprised of adapter plate 10. Adapter plate 10 is generally U-shaped and of flat and rigid form. Adapter plate 10 has a first plurality of pre-drilled holes 11 which are matched to vibrato mounting holes 32.

Adapter plate 10 also has a second plurality of pre-drilled holes 12 which are matched to the tailpiece mounting holes 23. The dimensional layout of the tailpiece mounting holes 23 is fairly standard in the guitar industry and for this reason the vibrato adapter 1 of the present invention is usable for mounting to various different brands of guitars. Each of the second plurality of pre-drilled holes 12 have a countersunk bore 14 to allow the flush mounting of adapter plate mounting screws 13. The adapter plate mounting screws 13 are typically of flat-head design and of countersink profile whereby flush mounting is further facilitated. Generally, the first plurality of pre-drilled holes numbers four and the second plurality, two.

The first plurality of pre-drilled holes 11 is located on the adapter plate 10 so that a string hold-down bar 25 of the vibrato device 30 is positioned, when adapter plate 10 is mounted, over the location on guitar 20 previously occupied by tailpiece 21. This positioning assures that the downward bend of the strings 22 over a bridge 26 remains at the critical angle for retaining strings 22 in their saddle locations. Since the positioning also coincides with the mounting location for the adapter plate mounting screws 13, any moment arm for torque applied to the adapter plate mounting by string tension is thereby eliminated.

Adapter plate 10 also comprises a means for concealment 16. In the preferred embodiment, the means for concealment 16 is the peripheral outline form 17 of adapter plate 10 cut to substantially match the shoe-print of the vibrato device 30 (FIG. 4). Adapter plate 10 further comprises a means for mounting-without-drilling-holes 18. In the preferred embodiment, the means for mounting-without-drilling-holes 18 is essentially the second plurality of pre-drilled holes 12, which permit use of the existing tailpiece mounting holes 23 and constitute sufficiently adequate fixturing for mounting purposes.

Figure 3:
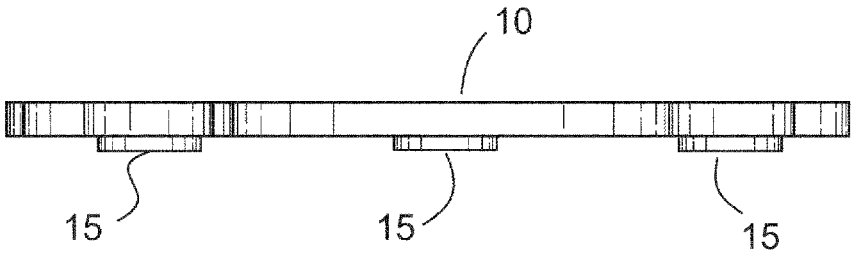
FIG. 3 is an end elevation view of the adapter plate of the present invention.
Figure 5:
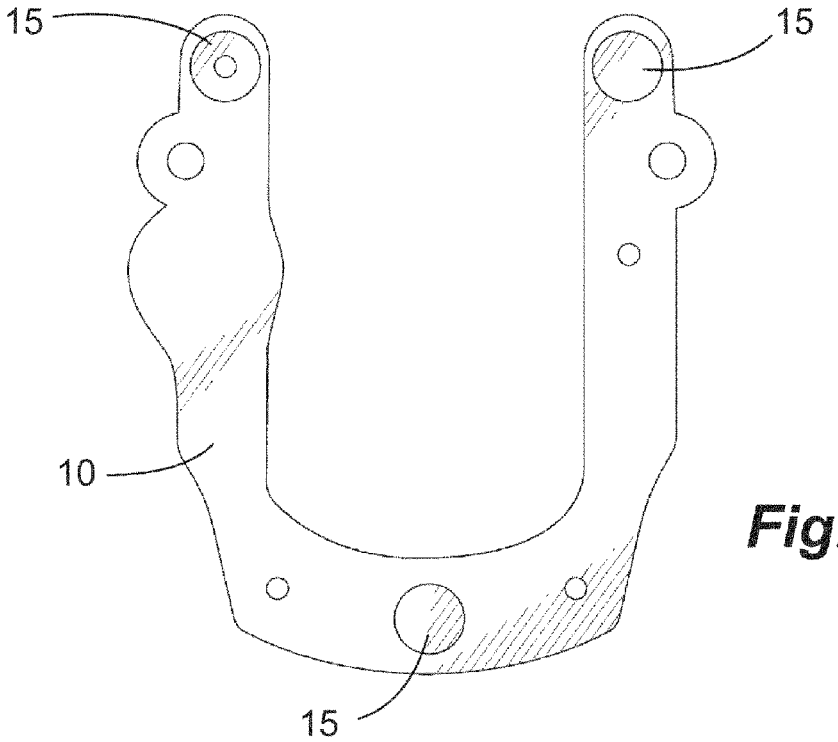
FIG. 5 is a bottom plan view the adapter plate of the present invention.

Referring to FIGS. 3 and 5, a plurality of non-abrasive pads 15 are attached to the bottom surface of adapter plate 10. The non-abrasive pads 15 protect the finish of the guitar 20, which is typically lacquered or polished and susceptible to marring. In the preferred embodiment, the plurality of non-abrasive pads 15 is three. The pads can be attached with pressure-sensitive adhesive. The non-abrasive pads 15 are preferably of a soft and compressible material, such as felt or rubber.

Figure 6:
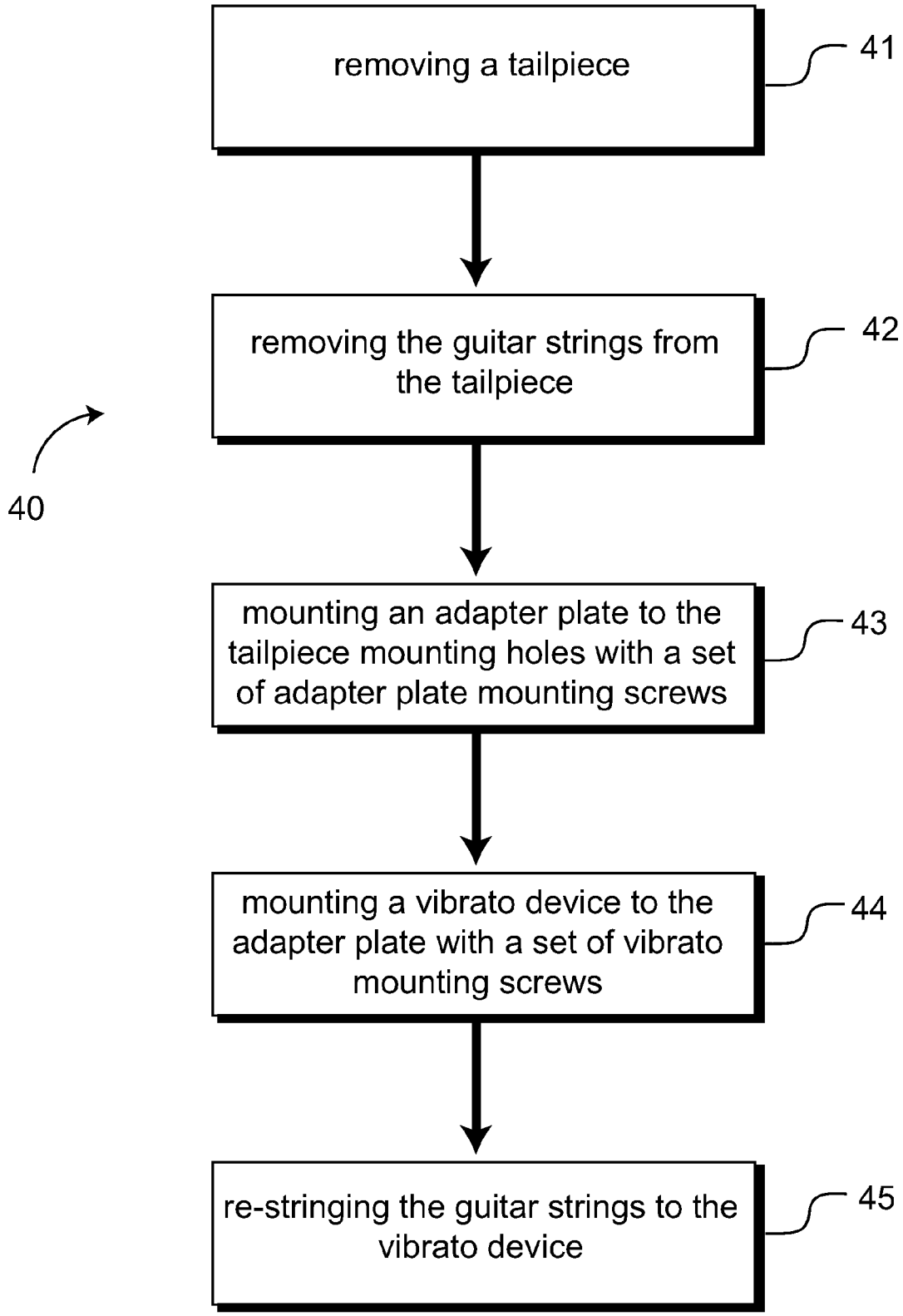
FIG. 6 is a process diagram showing the method steps for mounting a vibrato adapter to a guitar.

An alternative embodiment of the present invention is shown in FIG. 6. A method for installing a vibrato adapter 40 comprises the steps of removing a tailpiece 41; removing guitar strings from the tailpiece 42; mounting an adapter plate to the tailpiece mounting holes with a set of adapter plate screws 43; mounting a vibrato device to the adapter plate with a set of vibrato mounting screws 44; and re-stringing the guitar strings to the vibrato device 45.

In another alternate embodiment (not shown), a vibrato adapter kit comprises the vibrato mounting screws 33 in a set, the adapter plate 10, the adapter plate mounting screws 13 in a set, and installation and product care instructions.

The adapter plate 10 can be fabricated by cutting from plate stock comprised of any metal, by foundry casting, by thermoplastic injection molding, or by thermoset sheet-molding. In the preferred embodiment, the adapter plate is cut from 3/16 inch aluminum plate and surfaces can be anodized or brushed for a finished appearance. The U-shaped configuration permits a cutting layout wherein the adjacent parts are inverted from each other and nested within each other's open ends. This layout is particularly efficient with respect to material usage and selvage waste. The first and second pluralities of holes are drilled to register with, and correspond in the size to, the mounting holes in the vibrato device and the tailpiece, respectively. In the case of the first plurality of holes, the holes are tapped for threads to receive the vibrato mounting screws.

It should be appreciated that the vibrato adapter of the present invention has been designed for the specific purpose of providing a simple and effective means for securing a vibrato device to a guitar. This adapter can be used with any brand vibrato but is particularly usable with those vibratos manufactured by Bigsby. The use of the existing mounting holes of the musical instrument minimizes damage to the instrument and allows the vibrato device to be removed at any time without leaving witness markings. The trim profile of the design renders the adapter plate essentially invisible once the vibrato device is mounted in place.

It is to be understood that the invention is not limited in its application to the details of construction and to the arrangements of the components set forth in the preceding description or illustrated in the drawings. The invention is capable of other embodiments and of being practiced and carried out in various ways. Also, it is to be understood that the phraseology and terminology employed herein are for the purpose of the description and should not be regarded as limiting.

What is claimed is:

1. A vibrato adapter for a guitar having mounting holes for a tailpiece, comprising:

an adapter plate having a first plurality of pre-drilled holes matching the mounting holes of a vibrato device having mounting holes and a string hold-down bar, the first plurality of pre-drilled holes located on the adapter plate so as to position the string hold-down bar at the tailpiece location on the guitar, the adapter plate further having a means for concealment and a second plurality of pre-drilled holes matching the mounting holes for the tailpiece, wherein the vibrato device can be mounted to the guitar by fastening it to the first plurality of pre-drilled holes.

2. The vibrato adapter of claim 1, wherein the means for concealment comprises substantially matching the peripheral outline of the adapter plate to a shoe-print of the vibrato device.

3. The vibrato adapter of claim 1, further comprising the adapter plate in the shape of a "U".

4. The vibrato adapter of claim 1, wherein the second plurality of pre-drilled holes is two.

5. The vibrato adapter of claim 1, wherein each of the second plurality of pre-drilled holes further comprises a countersunk bore to allow flush mounting of a fastener therein.

6. The vibrato adapter of claim 1, further comprising a plurality of non-abrasive pads attached on the bottom of the adapter plate to protect the surface finish of the guitar.

7. A vibrato adapter kit for a guitar having mounting holes for a tailpiece, comprising:

a set of mounting screws for a vibrato device;

the adapter plate of the vibrato adapter of claim 1; and a set of mounting screws for the adapter plate compatible with the tailpiece mounting holes.

8. A method for installing a vibrato adapter on a guitar having strings and mounting holes for a tailpiece, comprising the steps:

removing the tailpiece;

removing the guitar strings from the tailpiece;

mounting the adapter plate of the vibrato adapter of claim 1 to the tailpiece mounting holes with mounting screws;

mounting a vibrato device to the adapter plate with other mounting screws; and re-stringing the strings onto the vibrato device.

* * * * *